United States Patent [19]

Moretta et al.

[11] Patent Number: 5,068,024

[45] Date of Patent: Nov. 26, 1991

[54] SLUDGE ADDITION TO A COKING PROCESS

[75] Inventors: Jon C. Moretta, Webster, Tex.; Robert D. Gombas, Jr., South Holland, Ill.

[73] Assignee: Amoco Corporation, Chicago, Ill.

[21] Appl. No.: 562,620

[22] Filed: Aug. 3, 1990

Related U.S. Application Data

[63] Continuation-in-part of Ser. No. 285,111, Dec. 15, 1988.

[51] Int. Cl.[5] ..... C10G 9/14

[52] U.S. Cl. ..... 208/13; 208/48 Q; 208/131

[58] Field of Search ..... 208/13, 48 Q, 131

[56] References Cited

U.S. PATENT DOCUMENTS

| | | | |
|---|---|---|---|
| 3,917,564 | 11/1975 | Meyers | 208/131 |
| 4,404,092 | 9/1983 | Audeh et al. | 208/131 |
| 4,501,654 | 2/1985 | Allan | 208/131 X |
| 4,552,649 | 11/1985 | Patterson et al. | 208/127 |
| 4,666,585 | 5/1987 | Figgins et al. | 208/131 |
| 4,874,505 | 10/1989 | Bartilucci et al. | 208/131 |

*Primary Examiner*—Curtis R. Davis
*Assistant Examiner*—William C. Diemler
*Attorney, Agent, or Firm*—Robert E. Sloat; William H. Magidson; Ralph C. Medhurst

[57] ABSTRACT

The present invention relates to a process and apparatus for injecting sludge into the vapor phase of a coking process to vaporize the sludge while minimizing the carryover of solids and coke to downstream equipment. The process and apparatus are applicable to use in both fluid and delayed coking operations and are useful on various sludges which can be found in refineries or petrochemical plants.

32 Claims, 2 Drawing Sheets

SLUDGE ADDITION TO A COKING PROCESS

This application is a continuation-in-part of U.S. Ser. No. 285,111, filed Dec. 15, 1988, the teaching of which are incorporated by reference.

BACKGROUND OF THE INVENTION

1. Field of the Invention

The field of art to which this invention pertains is hydrocarbon coking operations and in particular a process and apparatus adding refinery or petroleum sludge and oily wastes to a coking zone.

2. General Background

Coking operations in most modern refineries produce solid coke, vapor, and liquid products from heavy residual oil feedstocks which are fed to the coking process. The coking process can be either a delayed coking operation or a fluidized coking operation.

In fluid coking, a feedstock contacts a fluidized bed of coke particles maintained at a sufficiently high temperature to affect conversion of the feed to lighter liquid and vapor materials which are recovered from the fluidized bed of coke. Some of the coke particles formed in this operation are passed into a separate gasifier vessel where a portion of the coke particles are burned to produce additional heat. Heat is thus recycled back into the fluid bed of coke particles in the reaction section through these higher temperature coke particles which help maintain the desired process operations.

In the delayed coking process, delayed coking drums are used wherein a heavy residual oil is heated in a furnace and passed through a transfer line into a coking drum. In the coking drum, which is typically an elongated, cylindrical, vertically positioned vessel with an outwardly convex top and a downwardly converging frusto conical bottom, the residual feedstock is thermally decomposed with time into solid coke and vapor materials. The vapor materials formed during the coking reaction are recovered from the delayed coking drum and a solid coke material is left behind.

The vapor products are removed from the top of the coke drum through a coke drum outlet and passed through a coke drum overhead line which is connected to a fractionator, often called a combination tower. In the combination tower, gasesous and liquid products are recovered for further use in the refinery.

After a period of time, the feed to the coke drum is stopped and routed to another drum, and the coke laden drum is then purged of vapors, cooled, and opened so that the solid coke inside the drum can removed.

In operating a coking process, with the exception of needle coke production, the refiner generally aims to minimize coke production and maximize liquid products, since the latter are more easily converted into gasoline or other materials having higher economic values than the solid coke material.

Sludge production from a typical refinery or petrochemical plant can come from many sources including API separator bottoms, slop oil emulsions, storage tank bottoms, sludge from heat exchangers, oily waste, MEA reclaimer sludges, and other waste materials produced in the plant. The typical refinery sludge will contain solids, which may be organic, inorganic or combinations of both, along with oil, liquid and aqueous materials. Sometimes the sludge contains predominantly liquid materials and can be in the form of an emulsion.

In most refinery or petrochemical operations the sludge is often sent to a separator for gross removal of water and hydrocarbons after which the water and concentrated hydrocarbons and solids can be individually treated by landfarming or further biological or other known waste treatment means.

The refining industry has attempted to use various processes of adding sludge to a coking zone for sludge disposal.

U.S. Pat. No. 4,552,649 (U.S. Class 208/127) describes an improved fluid coking process where an aqueous sludge which comprises organic waste material is added to a quench elutriator to cool the coke in the elutriator and convert at least a portion of the organic waste to vaporous compounds which can be recycled to the fluid coking heating zone to increase the temperature of the fluid coke particles therein.

In the delayed coking process, sludges have been disposed of in various manners.

In U.S. Pat. No. 3,917,564 (U.S. Class 208/131), sludges or other organic by-products are added to a delayed coking drum during a water quenching step after feed to the coke drum has been stopped and the coke drum has been steamed to remove hydrocarbon vapors. The quenching step cools the hot coke within the coke drum to a temperature that allows the coke to be safely removed from the coking drum when it is opened to the atmosphere.

The sludge is added along with quench water and contacts the solid coke in the coke drum during the quench step at conditions which allow the vaporization of the water and some hydrocarbons contained in the sludge. Other organic and solid components of the sludge are left behind through deposition on the coke and removed from the coke drum as part of the solid coke product.

U.S. Pat. No. 4,666,585 (U.S. Class 208/131) relates to the disposal of petroleum sludge in a delayed coking process by adding the sludge to the coker feedstock and subjecting the mixture to delayed coking conditions.

German Patent DE 372606A1 relates to the disposal of petroleum sludge by adding sludge to the coke drum of a delayed coking process. The patent does not teach or disclose industry problems associated with solids entrainment and carryover or sludge injector reliability. U.S. Pat. No. 2,043,646 (U.S. Class 202/16) discloses a process for the conversion of acid sludge into sulfur dioxide, hydrocarbon and coke in a two-step procedure comprising passing sludge into a kiln to produce semi-coke and then passing the semi-coke into a coke drum for conversion into coke product.

U.S. Pat. No. 1,973,913 (U.S. Class 202/37) discloses a process where coke, which has been removed from a coking oven or coking drum, is quenched with polluted wastewater which contains tar acids. After quenching the tar acids can remain on the coke and the aqueous materials associated with these acids is vaporized.

U.S. Pat. No. 4,874,505 (U.S. Class 208/131) discloses a process where sludges are segregated according to water content. Sludges with a high water content are used as quench stream during the quenching phase of the coking cycle. Low water sludges are injected into the coke drum feed during the coking phase of the coking cycle.

U.S. Pat. No. 4,404,092 (U.S. Class 208/131) discloses a process for increasing the liquid yield of a delayed coking process by controlling the temperature of the vaporous space above the mass of coke in the coke drum by injecting a quenching liquid into the vapor phase within the delayed coking drum. The patent teaches that large amounts of liquid should be added to the vapor space within a delayed coking drum (about 9 percent by weight of the feed).

U.S. Pat. No. 2,093,588 (U.S. Class 196/61) discloses a process for delayed coking in which liquid materials, such as hydrocarbons or water, are passed into the vapor portion of a delayed coking zone. This patent teaches a process very similar, if not identical to, that disclosed in U.S. Pat. No. 4,404,092 described above.

In some of the alternative processes described above, certain disadvantages are present.

In cases where the sludge is added to the coke drum during the quenching cycle, the temperature of the solid coke which the sludge contacts may not be high enough decompose the sludge to coke and hydrocarbon vapors. While vaporization of the water contained in the sludge by the hot coke might occur, a concern exists that there may not be sufficient conversion or vaporization of the hydrocarbon component of the sludge. If the sludge contains toxic substances, they might not be converted to more acceptable and safer components.

In operations that inject sludge directly into the coke drum during a coking cycle, operational reliability problems can occur. The sludge injection apparatus is subjected to high temperatures and materials that can cause it to plug or be rendered inoperable. The sludge itself, once injected into the drum, can become entrained in the upflowing coke drum vapor stream, carried out of the coke drum, and deposited in downstream equipment such as the exit vapor piping or combination tower. Solids carryover in vapor piping can cause line fouling and excessive pressure drop that may exceed drum relief valve pressure. Solids carryover to the combination tower can plug the tower bottom outlet or plug the tower trays. Either item can require or cause a unit shutdown.

One of the other prior art processes entails the injection of sludge into the combination tower or directly into the coker hydrocarbon feed line. If the sludge is added to the combination tower or to any of the coker feed materials which pass through the coke heater furnace, there is a potential for fouling or coking of the furnace tubes or coker transfer lines because the sludge contains solids and often highly cokable hydrocarbon materials or materials that catalyze coking reactions. Additionally, in such instances, it is advisable to remove substantially all of the water from the sludge prior to injection into a high temperature hydrocarbon environment and consequently, additional processing equipment for this dewatering step is required. This is especially true if injection is into the furnace transfer line or into coke drum below the upper section.

A third alternative is injection of sludge into the coker blowdown system. In such a process, sludge is injected into the upper portion of the oil scrubber in the coker blowdown system and contacted with hot coke drum vapors during coke drum blow down, which can last a few hours a day. Water and light oils are vaporized and go overhead. Solids and heavy oil go out the bottom, and the heavy slop is fed to the coker combination tower and eventually passes through the coker feed furnace, transfer line and into the coke drum. This particular processing sequence also presents potential problems concerning the fouling of furnace tubes and feed or transfer lines to the coker.

It is an object of the present invention to convert a sludge which contains water and organics, and in other cases, water, liquid organics and solid organic or inorganic materials in a coking zone to recover useful and valuable products from the sludge.

It is an additional object of the invention to reduce the export of waste materials from a refinery or chemical plant by converting generally available sludges in a coking zone.

It is an additional object of the present invention to increase the yield of saleable or valuable products from sludge materials by processing them in a coking zone to convert at least a portion of the wastewater sludge to coke or liquid materials, which can be recovered from the coking process.

It is an additional object of the present invention to meet the above objectives without reducing liquid yields of the hydrocarbon feedstocks passed into the coking zone, and, additionally, without overloading downstream processing equipment with large volumes of aqueous vapor which need to be condensed.

It is an additional object of the present invention to perform the above objects without substantially reducing the partial pressure of hydrocarbons within the vapor phase within the coking zone.

It is an additional object of the present invention to perform the above objects without entraining and carrying-over solids from the sludge to downstream equipment.

It is an additional object of the present invention to provide a reliable apparatus to convey sludge to the coking zone while minimizing pluggage.

It is an additional object of the present invention to perform the above objects in a delayed coking process or in the fluid coking process. Preferably, the above process is performed in a delayed coking process.

SUMMARY OF THE INVENTION

The present invention includes a process for upgrading sludge including the step of passing a feedstock comprising a residual oil into a coking zone. The coking zone contains a low velocity vapor phase having a superficial vapor velocity of less than 10 feet per second, at coking conditions, during a coke production cycle. Solid coke and vapor products are produced in the process. A second step includes injecting a separate sludge stream into the low velocity vapor phase in the substantial absence of solid coke and coking foam produced from the feedstock and contacting the sludge with the vapor products at thermal treatment conditions to effect vaporization of at least a portion of the sludge.

In a specific instance, the invention includes a process for upgrading sludge including the step of passing a feedstock comprising residual oil into a delayed coking process including an elongated vertically positioned coke drum. The coke drum contains an upper vapor phase and a lower phase containing solid coke wherein the upper phase contains an upper high velocity vapor phase and an upper low velocity vapor phase. The upper low velocity vapor phase has a superficial vapor velocity of less than 1 foot per second and is located below the upper high velocity vapor phase and above the lower phase. The feedstock is injected into the coke drum at coking conditions during a coke production cycle to produce coke and vapor products. The process further includes the step of injecting a separate sludge stream into the coke drum through a drop tube terminating in the upper low velocity vapor phase, in the substantial absence of solid coke and coking foam produced from the feedstock, to contact the sludge with the vapor products at thermal treatment conditions to effect vaporization of at least a portion of the sludge.

In another specific instance, the invention includes a process for upgrading sludge, including the step of passing a feedstock comprising heavy hydrocarbon boiling in the range of from about 850° F. up to about 1250° F. at a feedstock temperature of from about 850° F. to about 970° F. to a delayed coking process. The process includes an elongated vertically positioned coke drum at coking conditions during a coke production cycle with an upper vapor phase and a lower phase containing solid coke wherein the upper phase contains an upper high velocity vapor phase and an upper low velocity vapor phase. The upper low velocity vapor phase has a superficial vapor velocity of between about 0.3 and 0.6 feet per second and is located below the upper high velocity vapor phase and above the lower phase. Coke and vapor products are produced from the feedstock. The process further includes the step of injecting a separate sludge stream into the coke drum through a drop tube terminating in the upper low velocity vapor phase, in the substantial absence of solid coke and coking form produced from the feedstock, to contact the sludge with the vapor products at thermal treatment conditions to effect vaporization of at least a portion of the sludge and conversion of at least a portion of the sludge to coke.

The present invention further includes an apparatus for the upgrading of sludge including a cylindrical vertically positioned delayed coking drum with an outwardly convex top and a downwardly converging frusto conical bottom. The drum includes an upper section containing an outlet nozzle and a lower section containing solid coke at drum operation capacity wherein the upper section contains an upper high velocity vapor section positioned within the outwardly convex top of the drum and an upper low velocity vapor section positioned below the upper high velocity vapor section and above the lower section for processing a feedstock comprising residual oil and producing solid coke and vapor products. The apparatus further includes a sludge injection drop tube communicating with the coking drum and terminating in the upper low velocity vapor section, the drop tube aligned parallel to the vertical wall of the vertical positioned drum, for injection of a sludge stream into the coke drum to effect vaporization of at least a portion of the sludge.

In a specific instance, the invention includes the apparatus above with the sludge injection drop tube communicating with the coking drum and terminating in the upper low velocity vapor section not less than 5 feet above the lower section for injection of a sludge stream into the coking drum at a drop tube liquid velocity of not less than 1 foot per second to effect vaporization of at least a portion of the sludge.

A more detailed explanation of the invention is provided in the following description and appended claims.

DESCRIPTION OF THE PREFERRED EMBODIMENTS

In a broad embodiment, the claimed process and apparatus relates to a process and apparatus for the addition of sludge to the low velocity vapor phase of a fluidized coking zone or a delayed coking drum.

In a preferred embodiment, the claimed process relates to a delayed coking process in which sludge is added to the vapor phase within a delayed coking drum at conditions that effect the conversion of the sludge to coke and vapor materials and the retention within the coke drum of the solid materials produced from the sludge injected into the coke drum.

In another preferred embodiment, the claimed apparatus relates to a mechanism for adding sludge to the low velocity vapor phase of a delayed coking drum at conditions to effect conversion of the sludge to coke and vapor materials, while substantially limiting solids carryover to downstream equipment and limiting downtime caused by sludge injection system downtime.

Figure 1:
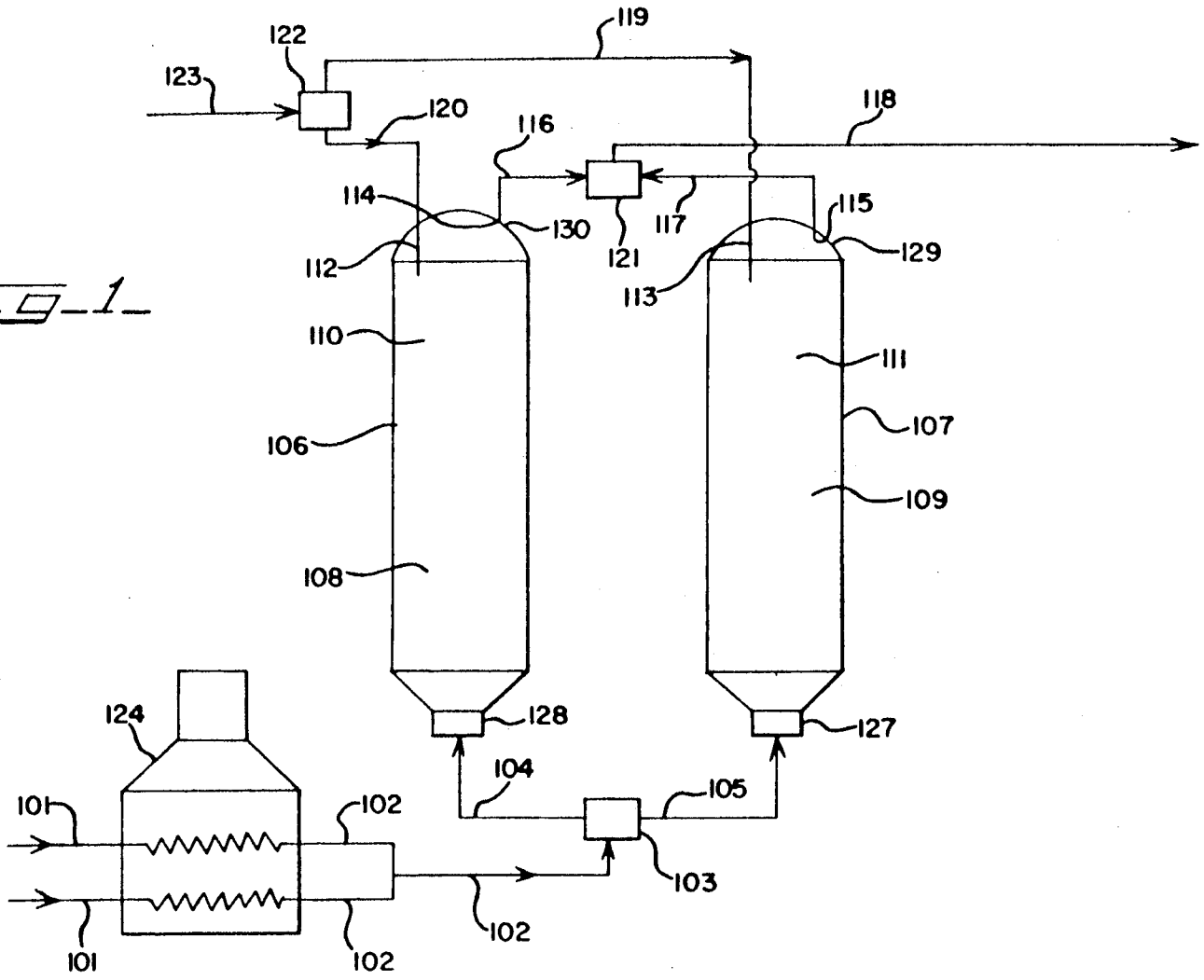
FIGS. 1 and 2 show various aspects of the present invention with respect to a delayed coker operation.

FIG. 1 shows various aspects of the present invention with respect to a delayed coking operation.

In FIG. 1, lines 101 carry a residual or heavy feedstock through furnace heater 124. Lines 102 carry heated residual feed through diverter valve 103 and into lines 104 and 105, depending upon which coke drum the residual feed enters. Lines 102, 104, and 105 are generally referred to as the transfer line.

Coke drums 106 and 107 are elongated, cylindrical, vertically positioned elongated vessels with an outwardly convex top and a downwardly converging frusto conical bottom into which feed can pass through inlets 127 and 128. The heated feed within the coke drum passes in an upward direction and, via the coking reaction, is ultimately converted to solid coke, which remains within the coke drum, and liquid and vapor materials. The coke drums 106 and 107 have lower sections 108 and 109, respectively, and upper sections 110 and 111, respectively. Typically, the lower sections will contain solid coke, while the upper sections will generally contain only vapor product which leaves the coke drums through the vapor outlets 114 and 115, respectively. The vapor or coke drum outlets 114 and 115 may be positioned on the top of the coke drum along the vertical longitudinal axis of the drum, on the top of the coke drum and radially outward from the vertical longitudinal axis of the drum, or on the side of upper sections 110 and 111.

The vaporized products leave overhead transfer lines 116 or 117, pass through diverter valve 121 and into line 118, which passes these products into a fractionation column for further separation.

In normal operations the diverter valves 103 and 121 isolate one of the coke drums from the process while the other coke drum is being filled with residual or heavy feedstock for the formation of coke. The isolated coke drum, after being cooled during the quench cycle, can then have its inlet and upper portions removed and coke can be removed from the coke drum.

Sludge passes through line 123 through diverter valve 122 and into lines 119 or 120 depending on which coke drum residual feed is passing. Lines 119 and 120 carry the sludge to the coke drum head. Lines 112 and 113, which are connected to lines 120 and 119, respectively, carry sludge into the upper section of the coke drum. Preferably, these lines are in a vertical position, and even more preferably, have their outlets located at a sufficient distance down from the top of the coke drum to allow the sludge to enter the coke drum at a point where there is minimal upward vapor velocity within the upper section of coke drum. Typically, this point will be the widest location within the coke drum.

Figure 2:
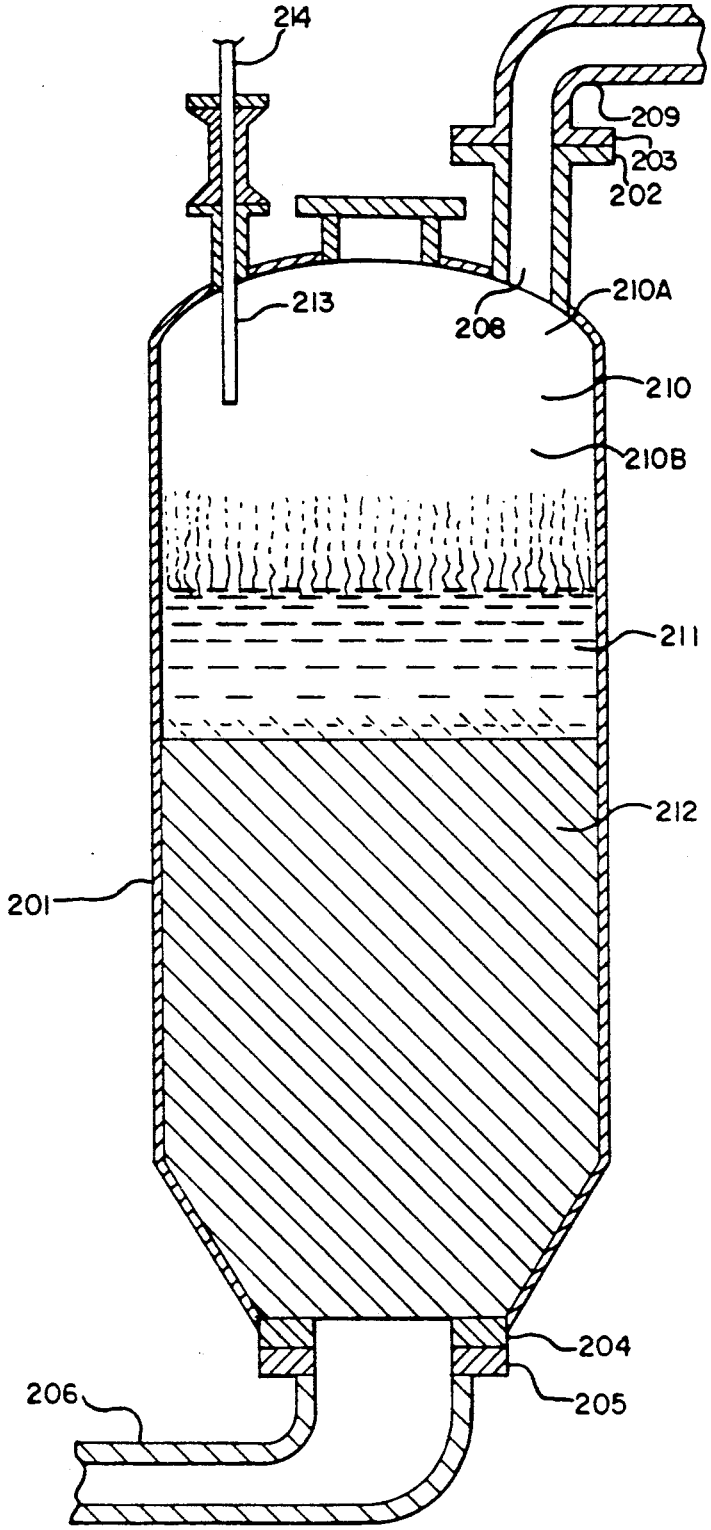

FIG.2 shows a specific design for a process and apparatus claimed herein.

Coke drum 201 contains solid coke in a lower section 212, an interface where liquids are being converted to coke in section 211, and an upper section 210 within the coke drum which contains vapor product leaving the interface. The upper section 210 further comprises an upper high velocity vapor phase 210A, which is positioned within the outwardly convex tops of coke drums 106 and 107, and an upper low velocity vapor phase 210B, positioned below the upper high velocity vapor phase 210A.

Residual feed passes through transfer line 206 through flanges 204 and 205 into the coke drum where through the coking reaction, the liquid hydrocarbon is converted to solid coke and vapor product. The vapor product eventually leaves the coke drum through vapor outlet 208 through flanges 202 and 203 and passes into line 209 which is connected to a fractionation zone.

Sludge can enter the coke drum through sludge injection drop tubes 213 and 214. The portion of drop tube 213 which extends within the coke drum preferably terminates in the upper low velocity vapor phase 210B where the vapor velocity in an upward direction within the coke drum is at a minimum in order to minimize carrying of solids and liquids in the sludge into overhead line 209.

Sludge typically comprises organic and inorganic waste materials mixed with water and generally in the form of a mixture of one or more liquids, often with solids. Individual sludges, as shown in Table I below, can vary greatly in the concentrations of water, solids and liquid organic materials (such as hydrocarbon oil), depending on the source of the sludge. They can be in the form of suspensions, emulsions, or slurries and generally contain large amounts of water. In some cases, the sludge can comprise only liquid materials, and in other cases, the sludge can comprise a thick slurry of heavy liquids and solid material.

When the individual sludges are combined for addition to the coking zone, the composition of the combined sludge can comprise anywhere from less than one up to about 30 weight percent or more solids, from less than one up to about 70 weight percent or more hydrocarbon oils, and up to 98 weight percent or more water.

In some cases, the sludge can comprise water and hydrocarbon oil with very little, if any, solids. The individual sludges may comprise up to 80 or more weight percent solids, up to 80 or more weight percent of hydrocarbon oils, and up to 98 weight percent or more water.

The oil or organic material may be solid, semi-solid or a liquid material and is preferably a hydrocarbonaceous material. The solid may comprise organic or inorganic material and, in some cases, can comprise both. Preferably, the aqueous sludge is an industrial sludge derived from wastewater treatment plants of petroleum refineries and petrochemical plants comprising hydrocarbonaceous materials.

Table I below shows sludge production, and solid and liquid hydrocarbon oils contents (the remaining material being water) for aqueous sludges found in a typical refinery producing a broad range of refinery products:

TABLE I

| Aqueous Sludge Description | Solids Wt. % | Liquid Oil Wt. % | Pounds Per Day | |
|---|---|---|---|---|
| API Separator Bottoms | 3.9 | 2.5 | 6,600 | |
| Slop Oil Emulsions | — | 84.0 | 3,280 | |
| Leaded Tank Bottoms | 6.1 | — | 30 | |
| Unleaded Tank Bottoms | 66.0 | 12.0 | 3,030 | |
| Heat Exchange Sludge | 17.0 | — | 6 | |
| Oily Waste | — | 7.7 | 55 | |
| MEA Reclaimer Sludge | 6.2 | 0.2 | 99 | |
| ASP Sludge from Digester | 2.0 | 0.34 | 22,600 | |
| Average | 7.6 | 9.4 | 35,700 | Total |

In delayed coking operations, coke formation reactions are essentially endothermic with the temperature dropping as the formation of coke, liquid and vapor products occur within the coke drum. The temperature drop can start when the feed material leaves the feed furnace and passes through the transfer line connecting the furnace to the coke drum. A temperature drop also occurs in the delayed coking drum where most of the coking reactions occur.

During normal operations, temperature differences in the coke drum will occur. For most residual feedstocks using normal delayed coking conditions producing anode or fuel grade coke, the vapor products leaving the coke drum through the coke drum vapor outlet are generally cooler than vapor which is leaving the interface between the vapor and the solid coke phases within the coke drum. The temperature drop between the residual feed entering the bottom of the coke drum and the vapor material leaving the coke drum vapor outlet will be approximately about 90° F. to 100° F. for normal operations.

Under normal coking conditions, the hydrocarbon vapor products in the upper section of the coke drum can vary in temperature from about 740° F. to 880° F., depending on the transfer line temperature, heat losses through the coke drum, and the endothermic heat of reaction for coke production. If a steam or hydrocarbon quench is used in the top of the coke drum, the temperature of the vapors in the top of the coke drum can be reduced. In such cases, the temperature of the vapors leaving the coke drum vapor outlet can be below 780° F. to about 800° F. Lower coke drum outlet temperatures can beneficially reduce coking and vapor overcracking in the overhead line. However, lower coke drum outlet temperatures can increase internal liquid recycle inside the coke drum, and if large quantities of quench materials are used, reduced feed throughput to the coking unit can result if drum capacity or cycle time is limiting. Quench or sludge addition rate can be optimized to maintain the coke drum outlet temperature at a target that achieves the process objectives of reducing overcracking and limiting overhead line coking while not creating an excessive capacity-limiting internal drum recycle.

Coking conditions include the use of heavy hydrocarbons such as residual feedstocks which pass into the coking drum through a transfer line maintained at a temperature anywhere from around 850° F. to about 970° F., preferably around 900° F. to about 950° F. For needle coke production where decanted oils are used as feedstocks, the transfer line temperature will be higher, generally from about 950° F. to about 970° F. Pressures are generally regulated in the coke drum anywhere from about atmospheric to about 250 psig, but preferably from about 15 to 150 psig. Vapor residence time in the coke drum can vary anywhere from a few seconds up to two or more minutes. Stripping steam can be added to the feed passing into the coke drum to help remove vapor materials from the produced coke at rates anywhere from about 0.2 to about five pounds of steam per hundred pounds of total feed passing into the coke drum through the transfer line.

Thermal treatment conditions can include: injection of the sludge into the upper section of a coke drum at a rate of from about 0.1 to about 10 percent by weight, based on the feedstock addition rate to the coking drum; sufficient temperature in the upper section of the coke drum to vaporize substantially any of the water and vaporizable hydrocarbons which may be present in the sludge while thermally decomposing some of the heavy hydrocarbons in the sludge to coke; migration of the above coke to the coke bed contained within the coke drum; and, preferably, injection of the sludge into the upper section of the coke drum at a point where the upward velocity of vapor in the drum will not entrain liquid or solids from the sludge.

If the sludge is dewatered, thermal treatment conditions can include vaporization of any vaporizable hydrocarbons and if cokable materials (liquids or solids) are present, they can be thermally decomposed into coke as a product or coproduct. In some cases, the cokable materials can be further thermally broken down into light hydrocarbon and some or all of the remaining heavy materials can be thermally converted to coke.

In some cases where the sludge contains no cokable materials, thermal treatment conditions include vaporization of the sludge, or thermal decomposition of the sludge into vaporous materials.

In a more preferred instance, the thermal treatment or sludge vaporization conditions include injection of the sludge into the upper section of the coke drum at a location where there is minimum upward vapor velocity of vapors within the upper section of the coke drum. This is preferred to prevent carryover of solids or heavy hydrocarbons contained in the sludge before decomposition can take place. This material can cause fouling of coke drum vapor outlet lines and associated downstream processing equipment.

Thermal treatment conditions also include temperatures in the upper section of the coke drum varying from about 740° F. up to about 850° F. Temperatures can vary depending on the type of feedstock being fed to the coker, the type of coke being produced, the sludge addition rate to the coke drum, and the composition of the sludge. Particular attention should be paid to maintaining a sufficiently high temperature in the upper section of the coke drum to allow toxic substances contained in the sludge to be decomposed into materials which are deemed safe in the refining industry or which can be more easily handled.

Thermal treatment conditions also include a preferred sludge addition rate of from about 0.01 to about 5 percent by weight, and even more preferably, from about 0.01 to 3 percent by weight, based on the feedstock addition rate to the coking drum. It is most preferable to maintain the sludge addition rate between 2 and 3 weight percent of the feedstock addition rate to the coke drum.

The upper and lower sections of a coking zone refer to the interior volume within a delayed coking zone which contains vapor products and the solid coke bed, respectively. The upper section also will contain sludge, since it is injected into this part of the coke drum.

During the normal operation of a delayed coker, the solid coke bed height within the coke drum gradually increases as more coke is produced. Accordingly, the volume encompassed by the lower section of the coke drum, which contains the solid coke bed, will also change to accommodate the increasing volume of solid coke produced in the coke drum.

The interface between the solid coke bed and the vapor phase within the coke drum will normally be comprised of liquid foam and can be located within the upper or lower section of the coke drum.

The sludge stream should be injected into the coke drum in the substantial absence of coke and coking foam. This is achieved by positioning the sludge injection point (drop tube) above the foam layer in the coke drum. Injection of the sludge into the foam layer or liquid/coke phase can create additional turbulence which creates additional foam and droplet entrainment in the vapor product stream. Injection of the sludge below the foam layer into the liquid/coke phase can also result in sludge injection drop tube pluggage. In the preferred case, the sludge injection drop tube should terminate at not less than 5 feet above the coke drum level (lower section) at coke drum operating capacity, to allow for foam level. This space also ensures sufficient vapor space in the upper section to allow vaporizable materials in the sludge to vaporize and the other materials to be converted to coke or returned to the coke bed as solids.

The sludge injection drop tube is vulnerable to coke pluggage due to high coke drum temperatures and the potential for entrainment of cokable materials in the vapor passing up through the coke drum. The drop tube is often at a lower temperature than other drum metallurgy because of the cooling afforded by the sludge flow in the tube. Lower tube temperatures can cause hydrocarbon condensation, further facilitating coke buildup.

Pluggage is reduced by the positioning (see above) and dimensioning of the sludge injection drop tube. The drop tube inner diameter should exceed at least 0.3 inches in order to prevent the lodging of larger particles in the tube, constricting the flow. The sludge liquid velocity in the drop tube should exceed 1 foot per second. More preferably, the sludge liquid velocity should range from 2 to 7 feet per second. Steam can be injected into the drop tube to maintain proper velocities in order to prevent drop tube plugging.

Placement of the sludge injection point (drop tube), within the upper section of the coke drum can be critical. The vapor velocity increases rapidly within the coke drum head or upper high velocity vapor phase and can be as high as 80 feet per second at the vapor outlet. In the upper high velocity vapor phase, the superficial vapor velocity is high enough to carry solids or liquid droplets from the upper section of the coke drum into the vapor outlet. This material can cause fouling of coke drum vapor outlet lines and associated downstream processing equipment.

Accordingly, the sludge injection point should be located within the upper section in a phase where reduced or minimum upward velocities occur. When locating the sludge injection point, consideration should also be given to the coking effects which may occur on surrounding internal equipment or surfaces in the coke drum. If the injection point is located too close to the coker wall, a cold spot may develop.

Preferably, that injection point should be located below the coke drum head and above the solid coke level in the upper low velocity vapor section of the coke drum. Specifically, the injection point should be located below the plane defining the intersection of the coke drum head with the straight walls of the coke drum.

In terms of vapor velocities within the coke drum, the sludge injection point should be located where the upward superficial vapor velocity during the coking cycle is less than 10 feet per second, more preferably, where the upward superficial velocity is less than one foot per second, and even more preferably, where the upward superifical velocity is about 0.3 to 0.6 feet per second or less.

Lower superficial velocities often occur on the side of the coke drum opposite the vapor outlet. For this reason, it is preferred that the sludge injection point be positioned on the side of the coke drum opposite the coke drum vapor outlet. Locating the injection point opposite the vapor outlet is also advantageous because entrained solids and liquid droplets, directed upwardly, have a longer travel path and grow in size, whereby some particles fall back into the coke bed. Positioning the injection point in the convex head without a drop tube or closer to, above, or below the vapor outlet could result in particulate being carried out of the drum.

In the case of a fluid coking operation, the sludge can be preferably passed into the upper dilute phase section of the fluidized coking reaction vessel. The sludge could also be passed directly into the dense bed of fluidized coke particles near the bottom of the vessel.

In delayed coking, since it is important to maintain relatively high temperatures in the upper section of the coke drum during sludge addition, the addition of sludge preferably should take place during the coke producing cycle of operations (when feedstock is being added to the coking drum).

Delayed coking operations are cyclic in nature, having the following general cycles of operations:

(1) coke production wherein heavy feedstock is fed to a heated coke drum under conditions which cause formation of solid coke and vapor products;
(2) a quenching cycle wherein steam usually followed by water is added to the coke drum, after feedstock addition has stopped, to cool the contents of the coke drum and purge it of hydrocarbon vapors;
(3) coke removal wherein the coke drum is opened to the atmosphere and solid coke is removed from the drum;
(4) a purge and pressure test cycle wherein the coke drum is filled with steam to remove air from the drum; and
(5) drum heat-up using hot vapor from another coking drum.

After the last cycle, the first cycle takes place.

It is especially preferable to add sludge to the coke drum only during the coke production cycle in order to take advantage of the higher temperatures which exist during this cycle. Adding sludge during the quenching cycle may prove deleterious, since cooling occurs within the coke drum, and any toxic substances in the sludge may not be converted to harmless coke, liquid, and gaseous products at the lower temperatures.

The residual oil passed into the coking zone generally boils in a range of from about 850° F. up to about 1250° F. or higher, with an initial atmospheric boiling point of anywhere from 850° F. to about 1150° F. and an end point around 1250° F. using the ASTM D-1160 analytical procedure at 1 millimeter mercury pressure. The coker feed is often the highest boiling fraction of crude oil processed in a refinery and can also contain materials derived from shale oil, tar sands, coal liquids, or other sources. Sometimes, part or all of the residual oil can be hydrotreated, visbroken or deasphalted during previous processing.

In some cases, the coker feed comprises a decanted oil produced from a fluid catalytic cracking process unit. Decanted oil will generally boil within a range of from about 450° F. to about 1150° F. using the above ASTM D-1160 test method. When the feed to the delayed coking zone is entirely decanted oil or other highly aromatic oils, needle coke can be produced. The feed can also comprise a blend of decanted oil and heavier residual oil derived from the above-described sources.

Coke still distillate, a distillate product from the coker, can be recycled along with the residual oil feed to the coking unit. Distillate product recycle helps reduce coke build-up in the coker furnace and transfer line, and increases the $C_5+$ liquid yields while reducing the solid coke yield. It can, however, reduce feed throughput through the coking unit, especially if the coking furnace is limiting, since the distillate oil displaces residual oil fresh feed.

Distillate oil generally has an atmospheric boiling range of from about 340° F. initial boiling point to about 750° F. end point using the standard ASTM D-86 analytical procedure at atmospheric pressure. It generally is removed from the coker combination tower as a fraction residing between naptha and the 650° F.+gas oil material.

The boiling ranges given above for the various materials described are not meant to unduly restrict their definitions. Often these materials may have initial or end boiling points outside the stated ranges due to the vagaries which occur during distillation operations in a refinery, or in the analytical techniques used. To the extent that these materials boil within the stated boiling ranges, they are to be considered the material described.

Stripping steam or water can be added to the feed at various points in the feed furnace to assist in maintaining desired velocities through the feed furnace. Normally, stripping steam can be added to the feed passing into coke drum in quantities of from about 0.2 to about 5 percent by weight of the feed furnace charge.

EXAMPLE

This Example illustrates one embodiment of the present invention. The data presented are based on data generated to study a design for a delayed coking unit.

The coke drum used had an inside diameter of 17.5 feet. The sludge injection tube entered the coke drum vertically through the coke drum head approximately 5 feet from the vertical center line of the coke drum. The sludge injection tube extended down just beyond the tangent line where the coke drum head meets the side walls.

The sludge was added after the commencement of coking cycle and stopped prior to the end of the cycle.

During sludge addition, the residual feed rate to the coke drum was set at 7500 barrels per day. The furnace coil outlet temperature was regulated at 925° F. and, before sludge addition was started, the temperature of the overhead vapor leaving the coke drum was at 825° F.

Sludge having the average composition shown in Table I was injected into the coke drum, as described above, at a rate of about 2 gallons per minute.

The sludge quenched the overhead vapors that would have left the coke drum from a temperature of 825° to a reduced temperature of about 795° F. to 805° F. The light oils and water contained in the sludge were vaporized and recovered in a downstream fractionation tower.

During sludge addition, 200 lbs. per hour of steam (150 psig) were mixed with the sludge to prevent coking in the sludge injection tube.

We claim as our invention:

1. A process for upgrading sludge comprising the steps of:

A. passing a feedstock comprising residual oil into a coking zone containing a low velocity vapor phase having a superficial vapor velocity of not more than about 10 feet per second, at coking conditions during a coke production cycle, to produce solid coke and vapor products; and B. injecting a separate sludge stream into said low velocity vapor phase in the substantial absence of solid coke and coking foam produced from said feedstock, and contacting said sludge with vapor products at thermal treatment conditions to effect vaporization of at least a portion of the sludge.

2. The process of claim 1 further characterized in that said coking zone comprises a delayed coking drum.

3. The process of claim 1 further characterized in that said sludge comprises water and organic material.

4. The process of claim 1 further characterized in that said sludge comprises liquid water and liquid hydrocarbon oil.

5. The process of claim 1 further characterized in that said sludge comprises water, liquid hydrocarbon oil, and solid material.

6. The process of claim 1 further characterized in that said coking zone comprises a delayed coking drum having an upper section comprising a high velocity vapor phase and a low velocity vapor phase each containing vapor products and a lower section containing solid coke, wherein said feedstock passes into said lower section of the coking drum and vapor products are removed from the upper section of said coking drum.

7. The process of claim 1 further characterized in that said residual oil comprises heavy hydrocarbons boiling in the range of from about 850° F. up to about 1250° F. or higher; said coking conditions include a feedstock temperature of from about 850° F. to about 970° F., a coking zone pressure of from about atmospheric to about 250 psig, and a coking zone vapor residence time of up to ten or more minutes; and a sludge addition rate of from about 0.01 to about 10 percent by weight, based on the feedstock addition rate to the coking zone.

8. The process of claim 2 further characterized in that said residual oil comprises heavy hydrocarbons boiling in the range of from about 850° F. up to about 1250° F. or higher; said coking conditions include a feedstock temperature of from about 850° F. to about 970° F., a coking zone pressure of from about atmospheric to about 250 psig, and a coking zone vapor residence time of up to ten or more minutes; and a sludge addition rate of from about 0.01 to about 10 percent by weight, based on the feedstock addition rate to the coking zone.

9. The process of claim 3 further characterized in that said residual oil comprises heavy hydrocarbons boiling in the range of from about 850° F. up to about 1250° F. or higher; said coking conditions include a feedstock temperature of from about 850° F. to about 970° F., a coking zone pressure of from about atmospheric to about 250 psig, and a coking zone vapor residence time of up to ten or more minutes; and a sludge addition rate of from about 0.01 to about 10 percent by weight, based on the feedstock addition rate to the coking zone.

10. The process of claim 6 further characterized in that said residual oil comprises heavy hydrocarbons boiling in the range of from about 850° F. up to about 1250° F. or higher; said coking conditions include a feedstock temperature of from about 850° F. to about 970° F., a coking zone pressure of from about atmospheric to about 250 psig, and a coking zone vapor residence time of up to ten or more minutes; and a sludge addition rate of from about 0.01 to about 10 percent by weight, based on the feedstock addition rate to the coking zone.

11. The process of claim 1 further characterized in that said thermal treatment conditions also include thermal conversion of at least a portion of the sludge to coke.

12. The process of claim 11 further characterized in that said residual oil comprises heavy hydrocarbon boiling in the range of from about 850° F. up to about 1250° F. or higher; said coking conditions include a feedstock temperature of from about 850° F. to about 970° F., a coking zone pressure of from about atmospheric to about 250 psig, and a coking zone vapor residence time of up to ten or more minutes; and a sludge addition rate of from about 0.01 to about 10 percent by weight, based on the feedstock addition rate to the coking zone.

13. The process of claim 12 further characterized in that said sludge comprises water and organic material.

14. The process of claim 13 further characterized in that said sludge comprises water and organic material.

15. The process of claim 14 further characterized in that said sludge comprises water, liquid hydrocarbon oil, and solid material.

16. The process of claim 1 further characterized in that the superficial vapor velocity of said low velocity vapor phase is not more than about 1 foot per second.

17. A process for upgrading sludge comprising the steps of:

A. passing a feedstock comprising residual oil into a delayed coking process comprising an elongated, vertically positioned coke drum containing an upper vapor phase and a lower phase containing solid coke, wherein said upper phase contains an upper high velocity vapor phase and an upper low velocity vapor phase, said upper low velocity vapor phase having a superficial vapor velocity of not more than about 1 foot per second and located below said upper high velocity vapor phase and above said lower phase wherein said feedstock is injected into said coke drum at coking conditions during a coke production cycle to produce coke and vapor products; and B. injecting a separate sludge stream into said coke drum through a drop tube terminating in said upper low velocity vapor phase, in the substantial absence of solid coke and coking foam produced from said feedstock, to contact said sludge with vapor products at thermal treatment conditions to effect vaporization of at least a portion of the sludge.

18. The process of claim 17 further characterized in that thermal treatment conditions also include thermal conversion of at least a portion of the sludge to coke.

19. The process of claim 17 further characterized in that said residual oil comprises heavy hydrocarbons boiling in the range of from about 850° F.up to about 1250° F. or higher; said coking conditions include a feedstock temperature of from about 850° F. to about 970° F., a coking zone pressure of from about atmospheric to about 250 psig, and a coking zone vapor residence time of up to ten or more minutes; and a sludge addition rate of from about 0.01 to about 10 percent by weight, based on the feedstock addition rate to the coking zone.

20. The process of claim 19 further characterized in that thermal treatment conditions also include thermal conversion of at least a portion of the sludge to coke.

21. The process of claim 17 further characterized in that the superficial vapor velocity of said upper low velocity vapor phase ranges from about 0.3 to about 0.6 feet per second.

22. A process for upgrading sludge comprising the steps of:

A. passing a feedstock comprising heavy hydrocarbon boiling in the range of from about 850° F. up to about 1250° F. at a feedstock temperature of from about 850° F. to about 970° F. to a delayed coking process comprising an elongated, vertically positioned coke drum at coking conditions during a coke production cycle wherein said coke drum contains an upper vapor phase and a lower phase containing solid coke, wherein said upper phase contains an upper high velocity vapor phase and an upper low velocity vapor phase, said upper low velocity vapor phase having a superficial vapor velocity of between about 0.3 and 0.6 feet per second located below said upper high velocity vapor phase and above said lower phase, to produce coke and vapor products from said feedstock; and B. injecting a separate sludge stream into said coke drum through a drop tube terminating in said upper low velocity vapor phase and in the substantial absence of solid coke and coking foam produced from said feedstock, contacting said sludge with vapor products at thermal treatment conditions to effect vaporization of at least a portion of the sludge and conversion of at least a portion of the sludge to coke.

23. The process of claim 22 further characterized in that said sludge is added at a rate of from about 0.01 to about 3 percent by weight, based on the feedstock addition rate to the coking drum.

24. The process of claim 22 further characterized in that said sludge comprises from about 1 to about 30 percent, by weight, of organic and inorganic solids, from about 1 to about 70 percent, by weight, of liquid hydrocarbons and from about 0 to about 98 percent, by weight, of water.

25. An apparatus for the upgrading of sludge comprising:

A. a cylindrical, vertically positioned delayed coking drum with an outwardly convex top and a downwardly converging frusto conical bottom wherein said drum contains an upper section containing an outlet nozzle and a lower section for containing solid coke at drum operating capacity, wherein said upper section contains an upper high velocity vapor section positioned within the outwardly convex top of the drum and an upper low velocity vapor section positioned below said upper high velocity section and above said lower section for processing a feedstock comprising residual oil and producing solid coke and vapor products; and B. a sludge injection drop tube communicating with said coking drum and terminating in said upper low-velocity vapor section, said drop tube aligned parallel to the vertical wall of said vertically positioned drum, for injection of a sludge stream into said coke drum to effect vaporization of at least a portion of the sludge.

26. The apparatus of claim 23 further characterized in that said sludge stream is injected through said drop tube at a liquid velocity of not less than 1 foot per second.

27. The apparatus of claim 23 further characterized in that said sludge injection drop tube terminates in said upper low velocity vapor section not less than 5 feet above said lower phase.

28. An apparatus for the upgrading of sludge comprising:

A. a cylindrical, vertically positioned delayed coking drum with an outwardly convex top and a downwardly converging frusto conical bottom wherein said drum contains an upper section containing an outlet nozzle and a lower section for containing solid coke at drum operating capacity, wherein said upper section contains an upper high velocity vapor section positioned within the outwardly convex top of the drum and an upper low velocity vapor section positioned below said upper high velocity section and above said lower section for processing a feedstock comprising residual oil and producing solid coke and vapor products; and B. a sludge injection drop tube communicating with said coking drum and terminating in said upper low-velocity vapor phase not less than 5 feet above said lower section, for injection of a sludge stream into said coking drum at a drop tube liquid velocity of not less than 1 foot per second, said drop tube aligned parallel to the vertical wall of said vertically positioned drum, to effect vaporization of at least a portion of the sludge.

29. The apparatus of claim 26 further characterized in that said sludge stream is injected through said drop tube at a liquid velocity of between about 2 and about 7 feet per second.

30. The apparatus of claim 26 further characterized in that said injection drop tube has an inner diameter of not less than 0.3 inches.

31. The apparatus of claim 28 further characterized in that said outlet nozzle extends from said outwardly convex top, radially outward from said vertical longitudinal axis of said top, and said sludge injection drop tube terminates 180° opposite said outlet nozzle about said vertical longitudinal axis.

32. The apparatus of claim 28 further characterized in that said outlet nozzle extends horizontally from said upper low velocity section of said coke drum and said sludge injection drop tube terminates 180° opposite said outlet nozzle about the vertical longitudinal axis of said coke drum.

* * * * *

UNITED STATES PATENT AND TRADEMARK OFFICE

CERTIFICATE OF CORRECTION

PATENT NO. : 5,068,024

DATED : November 26, 1991

INVENTOR(S) : Jon C. Moretta and Robert D. Gombas, Jr.

It is certified that error appears in the above-indentified patent and that said Letters Patent is hereby corrected as shown below:

The Title page, showing 32 claims should be deleted and substitute therefore the attached title page corrected as shown.

| Patent Column | Line | |
|---|---|---|
| 1 | 5 | "the teaching" should be --the teachings-- |
| 2 | 46 | "U.S. Patent 2,043,646" should begin new paragraph |
| 2 | 61 | "as quench stream" should be --as a quench stream-- |
| 8 | 31 | "cooler than vapor" should be --cooler than the vapor-- |
| 15 | 61 | Claims 25-32 should be cancelled |

Signed and Sealed this

Eighth Day of June, 1993

*Attest:*

Michael K. Kirk

MICHAEL K. KIRK

*Attesting Officer*

*Acting Commissioner of Patents and Trademarks*

United States Patent [19]

Moretta et al.

[11] Patent Number: 5,068,024

[45] Date of Patent: Nov. 26, 1991

[54] SLUDGE ADDITION TO A COKING PROCESS

[75] Inventors: Jon C. Moretta, Webster, Tex.; Robert D. Gombas, Jr., South Holland, Ill.

[73] Assignee: Amoco Corporation, Chicago, Ill.

[21] Appl. No.: 562,620

[22] Filed: Aug. 3, 1990

Related U.S. Application Data

[63] Continuation-in-part of Ser. No. 285,111, Dec. 15, 1988.

[51] Int. Cl.[5] ..... C10G 9/14

[52] U.S. Cl. ..... 208/13; 208/48 Q; 208/131

[58] Field of Search ..... 208/13, 48 Q, 131

[56] References Cited

U.S. PATENT DOCUMENTS

| | | | |
|---|---|---|---|
| 3,917,564 | 11/1975 | Meyers | 208/131 |
| 4,404,092 | 9/1983 | Audeh et al. | 208/131 |
| 4,501,654 | 2/1985 | Allan | 208/131 X |
| 4,552,649 | 11/1985 | Patterson et al. | 208/127 |
| 4,666,585 | 5/1987 | Figgins et al. | 208/131 |
| 4,874,505 | 10/1989 | Bartilucci et al. | 208/131 |

*Primary Examiner*—Curtis R. Davis
*Assistant Examiner*—William C. Diemler
*Attorney, Agent, or Firm*—Robert E. Sloat; William H. Magidson; Ralph C. Medhurst

[57] ABSTRACT

The present invention relates to a process and apparatus for injecting sludge into the vapor phase of a coking process to vaporize the sludge while minimizing the carryover of solids and coke to downstream equipment. The process and apparatus are applicable to use in both fluid and delayed coking operations and are useful on various sludges which can be found in refineries or petrochemical plants.

24 Claims, 2 drawing sheets

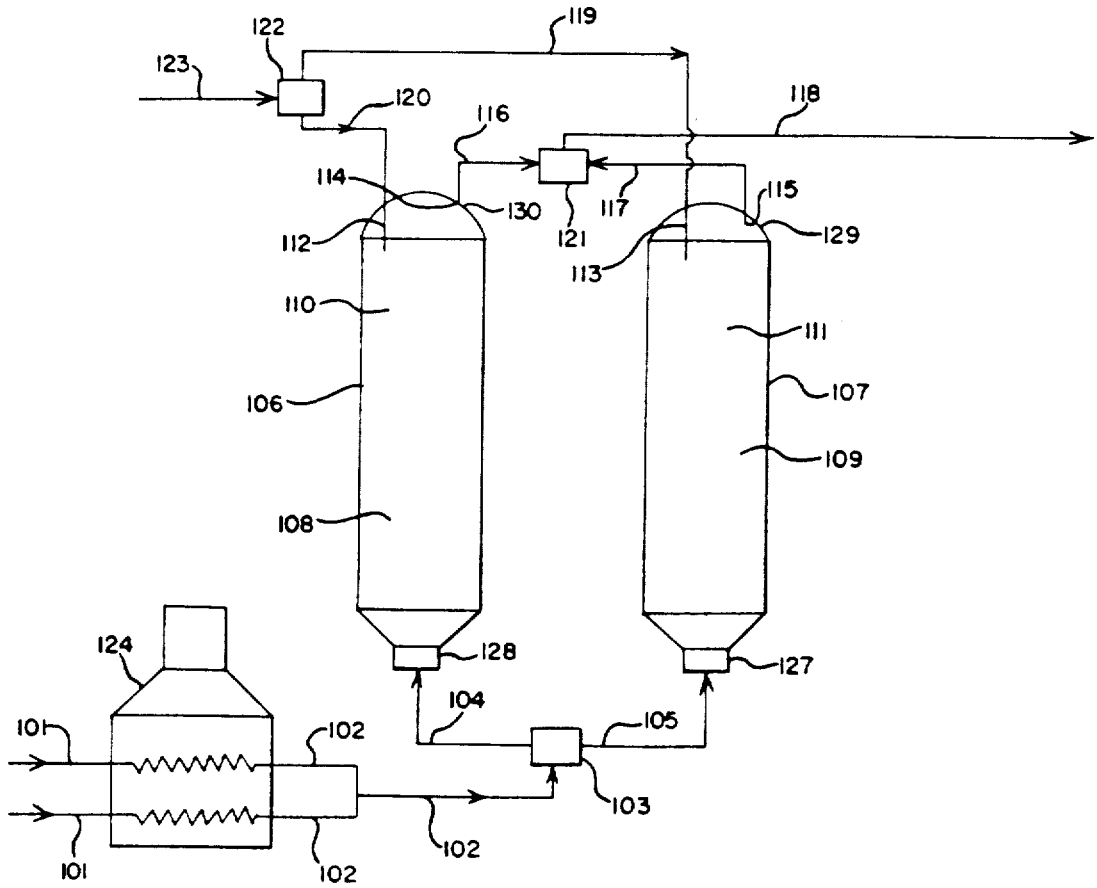

United States Patent [19]
Moretta et al.

[11] Patent Number: 5,068,024
[45] Date of Patent: Nov. 26, 1991

[54] SLUDGE ADDITION TO A COKING PROCESS

[75] Inventors: Jon C. Moretta, Webster, Tex.; Robert D. Gombas, Jr., South Holland, Ill.

[73] Assignee: Amoco Corporation, Chicago, Ill.

[21] Appl. No.: 562,620

[22] Filed: Aug. 3, 1990

Related U.S. Application Data

[63] Continuation-in-part of Ser. No. 285,111, Dec. 15, 1988.

[51] Int. Cl.[5] ..... C10G 9/14
[52] U.S. Cl. ..... 208/13; 208/48 Q; 208/131
[58] Field of Search ..... 208/13, 48 Q, 131

[56] References Cited

U.S. PATENT DOCUMENTS

| | | | |
|---|---|---|---|
| 3,917,564 | 11/1975 | Meyers | 208/131 |
| 4,404,092 | 9/1983 | Audeh et al. | 208/131 |
| 4,501,654 | 2/1985 | Allan | 208/131 X |
| 4,552,649 | 11/1985 | Patterson et al. | 208/127 |
| 4,666,585 | 5/1987 | Figgins et al. | 208/131 |
| 4,874,505 | 10/1989 | Bartilucci et al. | 208/131 |

*Primary Examiner*—Curtis R. Davis
*Assistant Examiner*—William C. Diemler
*Attorney, Agent, or Firm*—Robert E. Sloat; William H. Magidson; Ralph C. Medhurst

[57] ABSTRACT

The present invention relates to a process and apparatus for injecting sludge into the vapor phase of a coking process to vaporize the sludge while minimizing the carryover of solids and coke to downstream equipment. The process and apparatus are applicable to use in both fluid and delayed coking operations and are useful on various sludges which can be found in refineries or petrochemical plants.

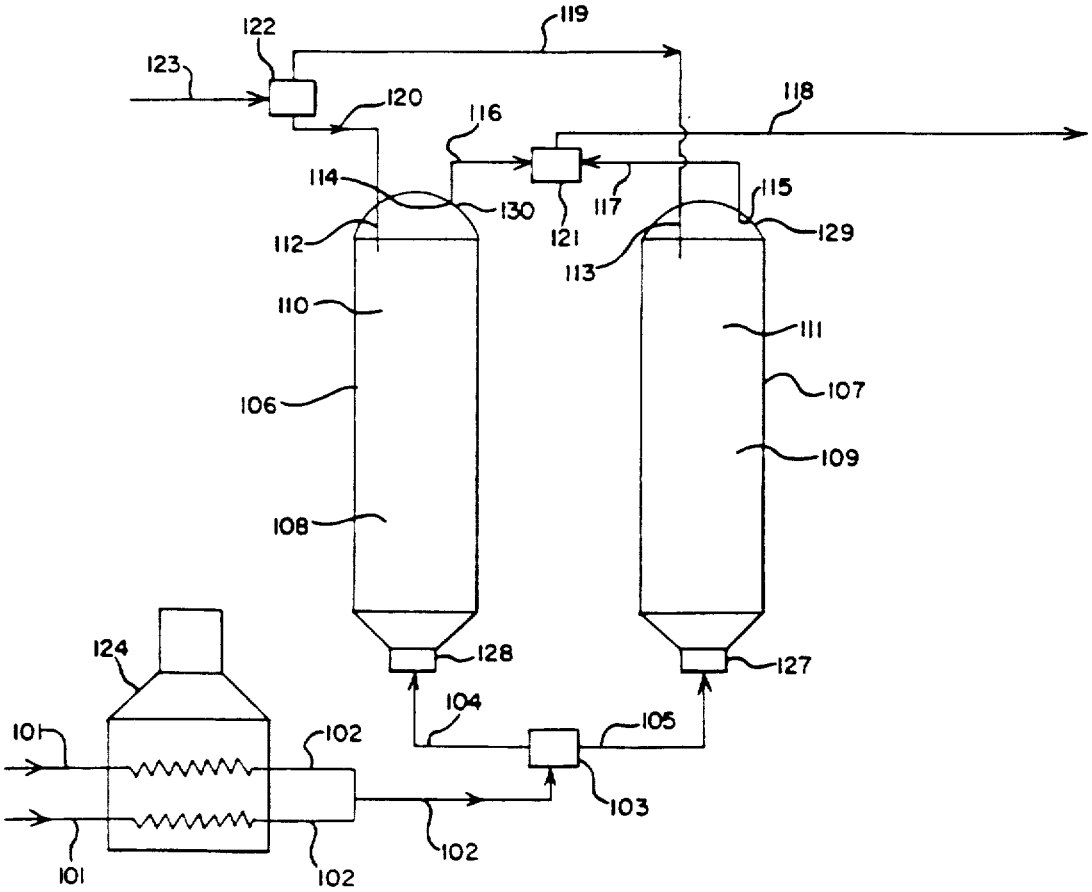

24 Claims, 2 drawing sheets